United States Patent [19]

Knox

[11] Patent Number: 4,633,959

[45] Date of Patent: Jan. 6, 1987

[54] DRILL HAVING MEANS FOR LOCATING CUTTING BIT IN A BIT HOLDER

[75] Inventor: John D. Knox, Louisville, Ky.

[73] Assignee: Vermont American Corporation, Louisville, Ky.

[21] Appl. No.: 748,857

[22] Filed: Jun. 26, 1985

[51] Int. Cl.[4] ..... E21B 10/58; E21B 10/62

[52] U.S. Cl. ..... 175/410; 175/418

[58] Field of Search ..... 175/410, 411, 417, 418; 408/231, 227; 407/118

[56] References Cited

U.S. PATENT DOCUMENTS

| | | | |
|---|---|---|---|
| 993,972 | 5/1911 | English | 175/410 |
| 2,902,260 | 9/1959 | Tilden | 175/410 |
| 3,049,033 | 8/1962 | Benjamin et al. | 175/410 |
| 3,807,515 | 4/1974 | Evans | 175/410 |
| 4,257,307 | 3/1981 | Regensburger | 408/231 |
| 4,356,873 | 11/1982 | Dziak | 175/410 |
| 4,433,739 | 2/1984 | Sarin | 175/410 |
| 4,492,278 | 1/1985 | Leighton | 175/410 |

FOREIGN PATENT DOCUMENTS

| | | | |
|---|---|---|---|
| 657432 | 9/1951 | United Kingdom | 175/410 |

*Primary Examiner*—James A. Leppink
*Assistant Examiner*—Hoang C. Dang
*Attorney, Agent, or Firm*—Harry B. O'Donnell, III

[57] ABSTRACT

A mining drill having a generally cylindrical, hollow bit holder and a cutting bit attached to the holder. The holder has a diametrically located web and two side wall surfaces projecting from opposite longitudinal sides of the web. A pair of cutting bit locating inclined surfaces are located on the web, each one of the inclined surfaces slanting toward a different one of the two wall surfaces. The cutting bit is sized and configures to be received in the space between the wall surfaces and has a flat bottom surface which rests on the web. The cutting bit is formed with two beveled notches, each notch receiving a different one of the inclined surfaces located on the web for locating the cutting bit in a predetermined relationship to the two side wall surfaces. The cutting bit is attached to the bit holder by solder between the cutting bit and side wall surfaces of the bit holder.

7 Claims, 8 Drawing Figures

DRILL HAVING MEANS FOR LOCATING CUTTING BIT IN A BIT HOLDER

BACKGROUND OF THE INVENTION

1. Field of the Invention

The present invention relates to mining drills and more particularly to locating a cutting bit to a drill bit holder comprising the drill.

2. Discussion of the Prior Art

Drills used in mining operations are known. U.S. Pat. Nos. 2,246,812; 2,521,791; and 3,807,515 show various examples of known drills.

Typical such mining drills include a head or bit holder and a separate drill bit in the form of a blade. The bit holder is formed with a slot or recess at its end which receives the drill bit. The drill bit is held in the slot by welding or brazing.

The drill bit blade must be accurately positioned relative to the bit head both transversely of the head and circumferentially of the head.

SUMMARY OF THE INVENTION

The present invention provides a straightforward solution to the problem of accurately locating a drill bit blade in a slot formed in a bit head of a mining drill.

More particularly, the present invention provides a drill comprising a generally cylindrical bit head, a diametrically located web extending across the bit head proximate one end thereof, means defining a first wall surface generally perpendicular to the web and extending part way along one side of the web to the periphery of the bit head, means defining a second wall surface generally perpendicular to the web and extending part way along the other longitudinal side of the web to the periphery of the bit head in the diametrical opposite direction to that in which the first wall surface extends such that the first and second wall surfaces are in off-set, parallel planes, first cutting blade locating means defining a first inclined surface projecting from the web spaced transversely across the web from the first wall surface and slanting toward the first wall surface, second cutting blade locating means defining a second inclined surface projecting from the web spaced transversely across the web from the second wall surface and slanting toward the second wall surface, a generally planar cutting bit blade having a width smaller than the transverse distance between the first and second wall surfaces and a generally flat bottom surface adapted to rest on the web, a first beveled surface formed in the flat bottom surface of the cutting bit blade for receiving one of the first or second inclined surfaces with the beveled surface in at least partial facing contact with the inclined surface received therein, and a second beveled surface formed in the flat bottom surface of the cutting bit blade for receiving the other one of the first or second inclined surfaces with the beveled surface in at least partial facing contact with the inclined surface received therein.

BRIEF DESCRIPTION OF THE DRAWINGS

A better understanding of the present invention will be had upon reference to the following description in conjunction with the accompanying drawings in which the numerals refer to the parts throughout and wherein.

DETAILED DESCRIPTION OF THE PREFERRED EMBODIMENT

Figure 2:
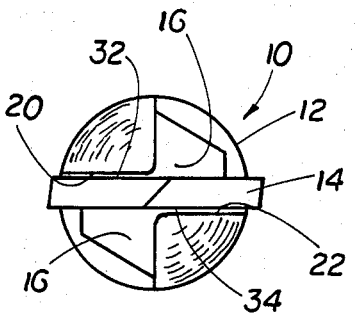
FIG. 2 is a top view of the mining drill of FIG. 1 as viewed in the direction of arrows 2—2 in FIG. 1.
Figure 1:
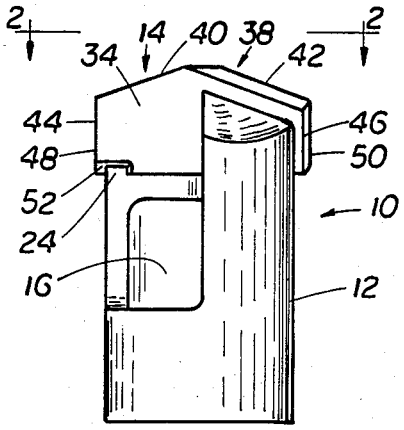
FIG. 1 is a side view of a mining drill incorporating the features of the present invention.

With reference to FIGS. 1 and 2, there is shown a mining drill, generally denoted as the numeral 10, including a generally cylindrically shaped drill bit head 12 and a drill bit blade 14 attached to the drill bit head 12 at one end thereof.

Figure 5:
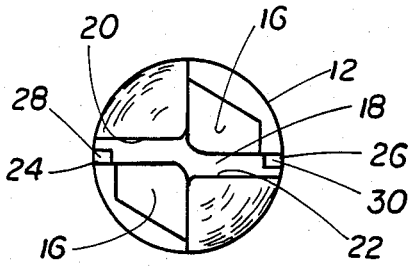
FIG. 5 is a top view of the drill bit head as seen in the direction of arrows 5—5 in FIG. 4.
Figure 3:
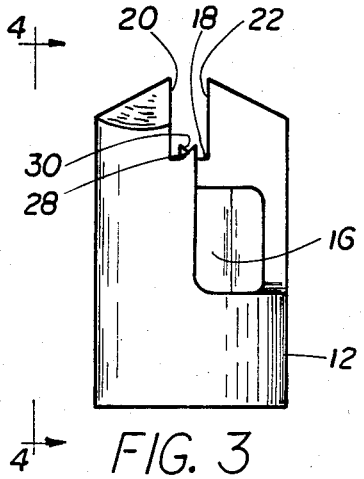
FIG. 3 is a side view of the drill bit head of the drill of FIG. 1.
Figure 4:
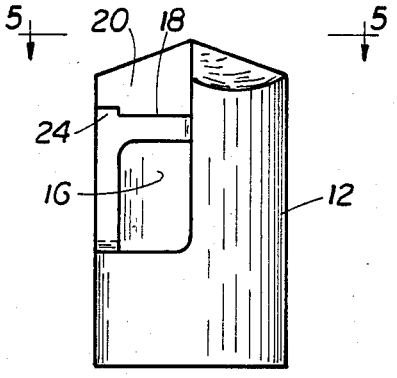
FIG. 4 is another side view of the drill bit head of FIG. 3 as seen in the direction of arrows 4—4 in FIG. 3.

With reference to FIGS. 3–5, the drill bit head 12 is hollow and is formed with two openings 16 through the peripheral wall. The top end of the drill 10 has a web 18 extending diametrically across the drill bit head 12 proximate the top end thereof. The drill web 18 has a substantially flat surface. The drill bit head 12 includes means defining a first wall surface 20 generally perpendicular to the flat surface of the web 18 and extending part way along one longitudinal side of the web 18 to the periphery of the bit head 12, and a second wall surface 22 generally perpendicular to the flat surface of the web 18 and extending part way along the other longitudinal side of the web 18 to the periphery of the bit head 12 in the diametrically opposite direction to that in which the first wall surface 20 extends. Thus the first wall 20 and second wall surface 22 are in off-set, parallel planes. Preferably, the first and second wall surfaces 20 and 22 each extend along more than half the length of the web 18, but less than the entire length of the web 18.

With continued reference to FIGS. 3–5, first and second drill bit blade locating means, generally denoted as the numerals 24 and 25, respectively, are located on the web 18 to properly locate the drill bit blade 14 both transversely and circumferentially on the drill head 12. As shown, the first drill bit locating means 24 defines a first inclined surface 28 projecting upwardly from the web 18 and spaced transversely across the web 18 from the first wall surface 20. The first inclined surface 28 slants toward the first wall surface 20 at an angle of, for example, approximately 45 degrees. Similarly, the second drill bit locating means 26 is shown as defining a second inclined surface 30 projecting upwardly from the web 18 spaced transversely across the web 18 from the second wall surface 22. The second inclined surface 30 slants toward the second wall surface 20 at an angle of, for example, approximagtely 45 degrees. The first inclined surface 28 of the first drill bit locating means 24 is in alignment with the second inclined surface 30 of the second drill bit locating means longitudinally of the web 18. In addition, the first drill bit locating means 24 and second drill bit locating means 26 are spaced apart longitudinally of the web 18. Thus, the first and second drill bit locating means 24 and 26, respectively, are diametrically spaced apart and are each located adjacent the periphery of the drill head 12.

Figure 6:
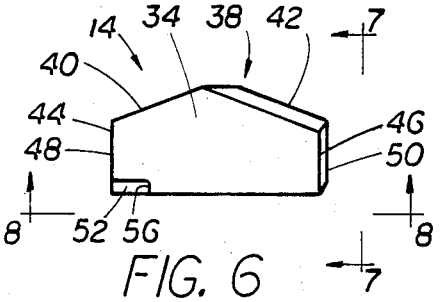
FIG. 6 is a perspective view of the drill bit blade of the present invention.
Figure 7:
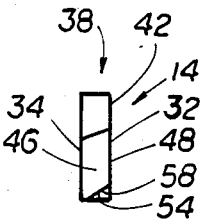
FIG. 7 is an end view of the drill bit blade as seen in the direction of arrows 7—7 in FIG. 6.
Figure 8:
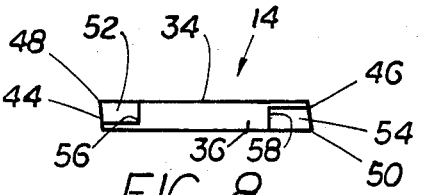
FIG. 8 is a bottom view of the drill bit blade as seen in the direction of arrows 8—8 in FIG. 6.

Now, with reference to FIGS. 6–8, there is shown the drill bit blade 14. The drill bit blade 14 is shown as being a generally planar having a width somewhat smaller than the width of the web 18 of the drill head 12 and a length which is longer than the diameter of the drill head 12. The side surfaces 32 and 34 are flat and parallel and the bottom surface 36 is flat and perpendicular to both side surfaces 32 and 34 and is adapted to rest on the web 18 of the drill head 12. The top surface 38 of the drill bit blade 14 is shown as being chevron spaped forming cutting edges 40 and 42. The opposite end surfaces 44 and 46 of the drill bit blade 14 are angled to form cutting edges 48 and 50. The drill bit blade 14 is formed with a first beveled surface 52 and a second beveled surface 54. The first and second beveled surfaces 52 and 54 are formed by first and second notches 56 and 58, respectively, in the bottom surface 36 of the drill bit blade 14. As shown, the notches 56 and 58 are located at opposite ends of the bottom surface 36 of the drill bit blade 14. The first and second beveled surfaces 52 and 54 slope in opposite directions transversely of the bottom surface 36 of the drill bit blade 14. The first and second beveled surfaces 52 and 54 are spaced apart along the longitudinal axis of the bottom surface 36 of the drill bit blade 14 by the same distance that the first and second drill bit blade locating means 24 and 26 are spaced apart along the longitudinal axis of the web 18 of the drill head 12.

When the drill bit blade 14 is located in alignment with the web 18 and with the bottom surface 36 on the web 18, the first notch 56 in the bottom surface of the drill bit blade 14 receives the first drill bit locating means 24 with the beveled surface 52 of the first notch 56 in contact with the inclined surface 28 of the first drill bit locating means 24 on the web 18, and the second notch 58 in the bottom surface of the drill bit blade 14 receives the second drill bit locating means 26 with the beveled surface 54 of the second notch 58 in contact with the inclined surface 30 of the second drill bit locating means 26 on the web 18. The interaction of the first drill bit locating means 24 received in the first notch 56, and the interaction of the second drill bit locating means 26 received in the second notch 58 locates the drill bit blade 14 centrally along the longitudinal axis of the web 18. Further, the coaction between the first inclined surface 28 of the first drill bit locating means 24 and first beveled surface 52 of the first notch 56 forces one flat side 32 of the drill bit blade 14 toward the first wall surface 20 of the drill head 12, and the coaction between second inclined surface 30 of the second drill bit locating means 26 and the second beveled surface 54 of the second notch 58 forces the other flat side 34 of the drill bit blade 14 toward the second wall surface 22 of the drill head 12.

The drill bit blade 14 is attached to the drill head 12 by, for example, soldering or brazing. The present invention provides for accurate location of the drill bit blade 14 on the drill head 12 during the assembly operation without the aid of jigs or fixtures and also removes operator error in the assembly process. Due to the interaction of the drill bit locating means 24 and 26 with the notches 56 and 58, as described above, the drill bit blade 14 is properly located across the drill head 12. Further, due to the coaction between the inclined surfaces of the drill bit locating means and beveled surfaces of the notches in the drill bit blade 14, the drill bit blade 14 is rotated or forced against the wall surfaces 20 and 22 next to the web 18 thus properly circumferentially positioning the drill bit blade 14 relative to the drill head 12 with sufficient force to hold the drill bit blade 14 in this position during the soldering or brazing operation.

Shaped pieces of brazing material can be inserted between the wall surfaces 20 and 22 of the drill head 12 and the adjacent flat side surfaces 32 and 34 of the drill bit blade 14. The assembled drill head 12 and drill bit blade 14 are then moved through a furnace having an inert atmosphere for the brazing operation. The coaction of the inclined surfaces 28 and 30 with the beveled surfaces 52 and 54 also provides for the proper spacial relationships between the wall surfaces 20 and 22 and the side surfaces 32 and 34 adjacent thereto in order to enhance the capillary flow of the molten brazing material into the space therebetween.

The foregoing detailed description is given primarily for clearness of understanding as modifications will become obvious to those skilled in the art upon reading this disclosure and may be made without departing from the spirit of the invention and scope of the appended claims.

What is claimed is:

1. A drill comprising:

(a) a generally cylindrical drill head;

(b) a web located proximate one end of the drill head extending diametrically across the drill head;

(c) means defining a first wall surface generally perpendicular to the web and extending part way along one longitudinal side of the web to the periphery of the drill head;

(d) means defining a second wall surface generally perpendicular to the web and extending part way along the other longitudinal side of the web to the periphery of the drill head in the diametrically opposite direction to that in which the first wall surface extends such that the first and second wall surfaces are in off-set parallel planes;

(e) first drill bit blade locating means defining a first inclined surface projecting from the web, spaced transversely across the web from the first wall surface and slanting toward the first wall surface, the first inclined surface being closer to the first wall surface than to the second wall surface;

(f) second drill bit blade locating means defining a second inclined surface projecting from the web, spaced transversely across the web from the second wall surface and slanting toward the second wall surface, the second inclined surface being closer to the second wall surface than to the first wall surface;

(g) a generally planar drill bit blade having a width smaller than the transverse distance between the first and second wall surfaces and a generally flat bottom surface adapted to rest on the web; and (h) a first beveled surface formed in the flat bottom surface of the drill bit blade for receiving the first inclined surface with the first beveled surface in at least partial facing contact with the first inclined surface; and (i) a second beveled surface formed in the flat bottom surface of the drill bit blade for receiving the second inclined surface with the second beveled surface in at least partial facing contact with the second inclined surface.

2. The drill of claim 1, wherein the first inclined surface of the first drill bit locating means and the second inclined surface of the second drill bit locating means are in spaced apart alignment longitudinally of the web of the drill head.

3. The drill of claim 2, wherein the first drill bit locating means is located adjacent the periphery of the drill head at one end of the web, and the second drill bit locating means is located adjacent the periphery of the drill head at the other end of the web.

4. The drill of claim 1, wherein the first and second beveled surfaces slope in opposite directions transversely of the bottom surface of the drill bit blade.

5. The drill bit of claim 4, wherein the first and second beveled surfaces are spaced apart longitudinally of the bottom surface of the drill bit blade.

6. A drill comprising:

(a) a generally cylindrical drill head;

(b) a web located proximate one end of the drill head extending diametrically across the drill head;

(c) means defining a first wall surface generally perpendicular to the web and extending part way along one longitudinal side of the web to the periphery of the drill head;

(d) means defining a second wall surface generally perpendicular to the web and extending part way along the other longitudinal side of the web to the periphery of the drill head in the diametrically opposite direction to that in which the first wall surface extends such that the first and second wall surfaces are in off-set parallel planes;

(e) first drill bit blade locating means defining a first inclined surface projecting from the web, spaced transversely across the web from the first wall surface and slanting toward the first wall surface;

(f) second drill bit blade locating means defining a second inclined surface projecting from the web, spaced transversely across the web from the second wall surface and slanting toward the second wall surface;

(g) a generally planar drill bit blade having a width smaller than the transverse distance between the first and second wall surfaces and a generally flat bottom surface adapted to rest on the web;

(h) a first notch formed in the bottom surface of the drill bit blade defining a first beveled surface formed in the flat bottom surface of the drill bit blade for receiving the first inclined surface with the first beveled surface in at least partial facing contact with the first inclined surface; and (i) a second notch formed in the bottom surface of the drill bit blade defining a second beveled surface formed in the flat bottom surface of the drill bit blade for receiving the second inclined surface with the second beveled surface in at least partial facing contact with the second inclined surface, said first and second beveled surfaces sloping in opposite in opposite directions transversely of the bottom surface of the drill bit blade, and said first and second beveled surfaces being spaced apart longitudinally of the bottom surface of the drill bit blade.

7. The drill of claim 6, wherein:

(a) the first inclined surface of the first drill bit locating means and the second inclined surface of the second drill bit locating means are in spaced apart alignment longitudinally of the web of the drill head; and (b) the first notch in the bottom surface of the drill bit blade and second notch in the bottom surface of the drill bit blade are in spaced apart alignment longitudinally of the bottom surface of the drill bit blade, and spaced apart by a distance corresponding to the distance between the first and second incliend surfaces longitudinally of the web.

* * * * *